United States Patent [19]

Früh

[11] 4,065,901

[45] Jan. 3, 1978

[54] CONNECTING ELEMENT FOR WALL OR CEILING PANELS WHEN CONSTRUCTED BY A DRY METHOD

[76] Inventor: Friedrich Früh, In der Boindte 12, 7441 Neckartenzlingen, Germany

[21] Appl. No.: 759,177

[22] Filed: Jan. 13, 1977

[30] Foreign Application Priority Data

Jan. 16, 1976 Germany ..... 2601498

[51] Int. Cl.[2] ..... E04C 1/28

[52] U.S. Cl. ..... 52/582; 52/489

[58] Field of Search ..... 52/385–387, 52/474, 479–489, 578–587

[56] References Cited

U.S. PATENT DOCUMENTS

| | | | |
|---|---|---|---|
| 2,018,911 | 10/1935 | Brill et al. | 52/582 X |
| 2,065,525 | 12/1936 | Hamilton | 52/582 X |
| 2,703,004 | 3/1955 | Kenedy | 52/582 X |
| 3,398,982 | 8/1968 | Venzie | 52/584 X |

FOREIGN PATENT DOCUMENTS

| | | |
|---|---|---|
| 571,590 of | United Kingdom | 52/387 |

*Primary Examiner*—J. Karl Bell

*Attorney, Agent, or Firm*—Watson, Cole, Grindle & Watson

[57] ABSTRACT

A connecting element for connecting and accurately positioning wall or ceiling panels or boards which comprises first and second longitudinally extending locating strips located in approximately the same plane, a gap-forming flange connected to the first and second strips and extending perpendicular thereto, each longitudinal end of the first and second locating strips having a clamping plate associated therewith, the clamping plates extending from the longitudinal ends of the gap-forming flange at the side thereof remote from the locating strip, the clamping plates extending in parallel with the associated locating strip, and lateral stops attached to one of the locating strips and each of the clamping plates in order to accurately position and support the appropriate panels or boards to be connected.

11 Claims, 16 Drawing Figures

CONNECTING ELEMENT FOR WALL OR CEILING PANELS WHEN CONSTRUCTED BY A DRY METHOD

The present invention is directed to connecting elements which are useful when cladding walls or ceilings by dry construction methods, the connecting elements joining together the front edges of oblong cladding panels which have the same width and consist of wood and/or a plastic material, their longitudinal edges being joined together in a tongue-and-groove connection system. Used in this disclosure, the term "panel" covers oblong-rectangular cladding boards or similar panelling elements which consist of solid wood or of chip board and which may be veneered or coated with a plastic foil. Both of the longitudinal edges of the panels may be provided with longitudinal grooves ("groove-groove profiles") or the panels may have "groove-tongue" edges.

It is an object of the present invention to provide connecting elements for a dry panel construction system of the kind described above, where three demands have to be met by the construction method in addition to being both extremely simple and inexpensive. On the other hand, the transverse joints between the panels should be located in the same plane, which means that there must be neither steps nor discontinuities; on the other hand, a gap should be provided between the consecutive panels which must have a constant width; and finally, it should not be difficult to find a suitable use for cut-offs which are an inevitable by-product of boards faced lengthwise.

To meet these demands, the new connecting piece according to the present invention is designed as a profiled element whose longitudinal median axis extends preferably transversely with respect to the longitudinal axis of the panels which are joined together, and which comprises two bearing strips located, at least approximately, in one common plane, each serving as a bearing for supports the underside of a front section of two adjacent panels, and each being provided, for example, with a stiffening flange which itself may include holes to accomodate e.g., fixing screws and the like. The bearing or locating strips are separated from each other by a locating wall which may have the form of a flange, with preferably a rectangular cross-section, and which determines the width of the gap between the strips. A clamping plate is associated with either end of the locating strips so as to provide a firm connection between the profiled connecting element and one of the panels which are to be assembled, the spacing between the clamping plate and the associated locating strip corresponding approximately to the spacing between the locating strip and the longitudinal groove in the panel edge. Finally, the new connecting element is provided with at least two lateral stopping members which function to fix the position of the corresponding contacting panel in the direction across the longitudinal axis of the connecting element, the spaces between the lateral stopping members corresponding either to the distance between the longitudinal edges of the corresponding panel or to the distance between the ground-faces of the longitudinal grooves which provide the connection between a given panel and the two panels adjacent to either of its longitudinal sides.

It is because of the presence of the locating wall or rather the gap-forming flange that the parts connected (panels) according to the invention include gaps having a reliably constant width. The locating strips, on the other hand, moreover ensure that the sections of panels at either side of the gap are located in the same plane which conveniently extends parallel to the plane of the wall or other structure to be panelled. An additional advantage is brought about by the interaction between the locating strips and the clamping plates which enables the joints between adjacent panels to be arranged at will, including the joints between two panel end faces, since these may be located even in free spaces between the consecutive slats or bars of the structure underneath. This is to say that there is no need for the joints to be supported at their back, and the cladding boards or panels may therefore be assembled independently of their individual length. Above all, they can be assembled in a way which does not have to comply with the length or system of the cladded structure. Off-cuts produced when cutting panels to their specified length may therefore be incorporated into the panelling wherever this is convenient. All this eliminates certain machining problems which have been experienced by industries concerned with the large scale manufacture of panellings, and at the same time encourages the ultimate consumer to take advantage of panelling boards, offering the additional advantage that off-cuts may be made to fit into any panelling scheme. With known, comparable manufacturing methods it has been usually necessary to machine the front faces of the profiled sections, which makes it impossible for the profiles to be shortened later if this is regarded advisable either by professional teams on a panelling site or by the handyman in his home. Moreover, cladding boards or panels may be now be obtained from stock since their length no longer has to correspond to the carrying members of the structure underneath and their spacing. Even remnant pieces discarded by furniture-making industries may be incorporated, for example, into the design of a door. To sum it up, by the present invention it is now possible to use any commercially available panels as cladding elements on walls and ceilings, whatever the dimensions of a room.

The connecting elements according to the present invention are equally suitable for the connection of panels or cladding boards which have groove, on either of their longitudinal edges. In this case the panels are joined along their longitudinal length together by the aid of a separate jointing strip. With panels or cladding boards having a groove on one of the longitudinal edges, the connecting elements of the present invention can be used together with an integral tongue on the opposite longitudinal edges, of the boards which fit into the grooves of the adjacent boards.

The arrangement according to the invention, moreover, equally suitable for the panelling of wooden and metal structures.

DESCRIPTIONS OF THE DRAWINGS

In the drawings, various views and embodiments of the invention are shown. In particular, FIG. 1 is an elevational front view of a first connecting element according to the invention;

Figure 10:
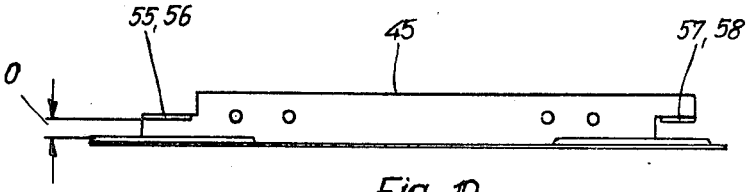
Figure 11:
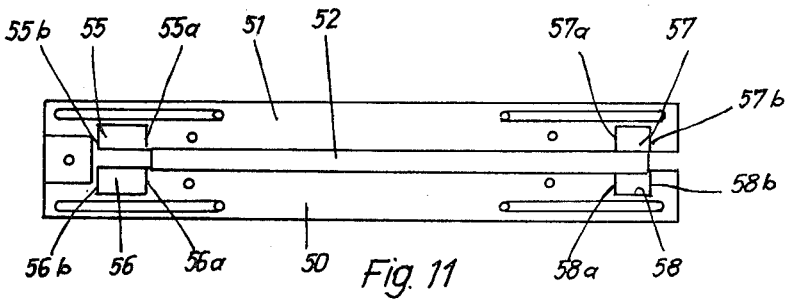
Figure 7:
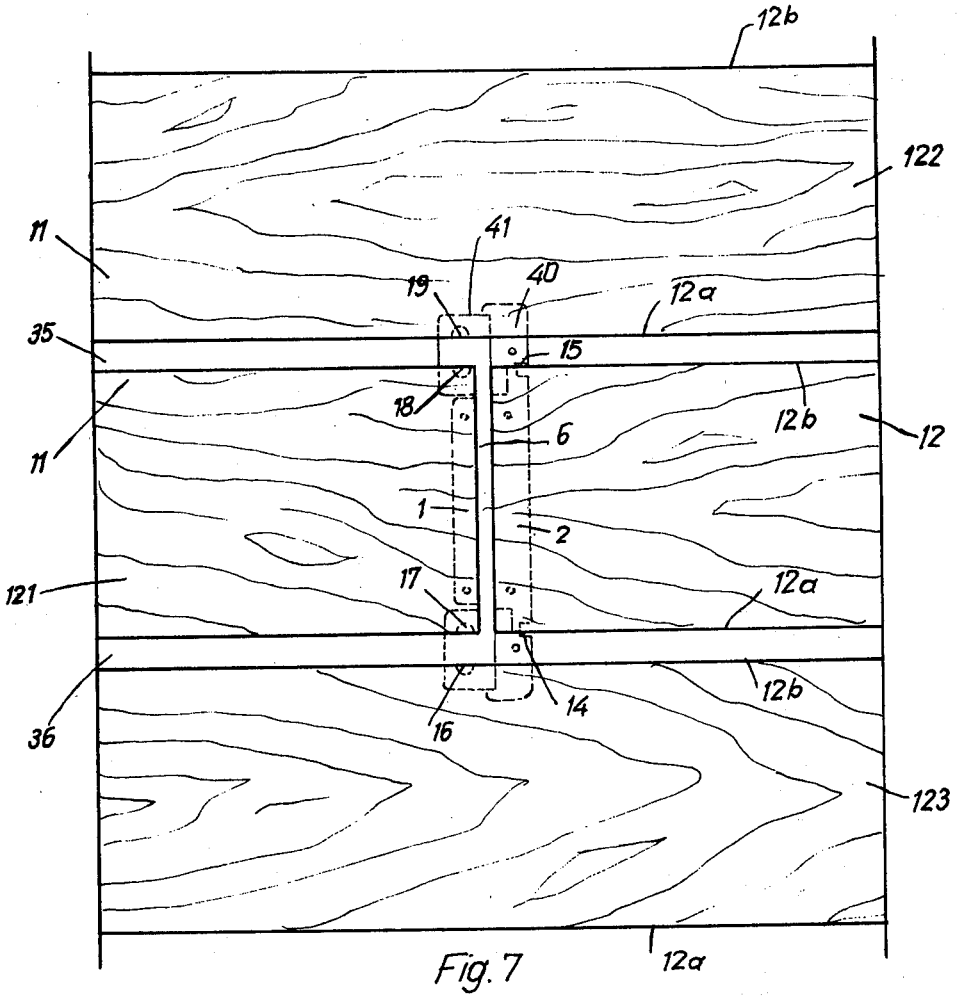
FIG. 7 shows a schematic presentation of the connecting element according to FIGS. 1 to 4 in its final position as part of the wall-or ceiling cladding according to the invention.
Figure 12:
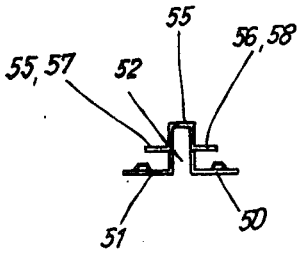
Figure 13:
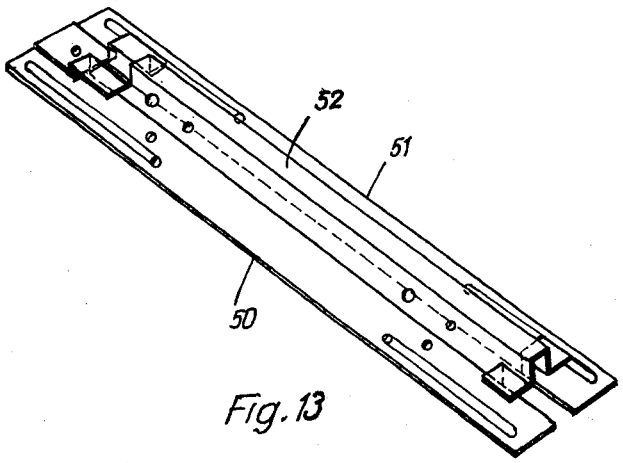
Figure 8:
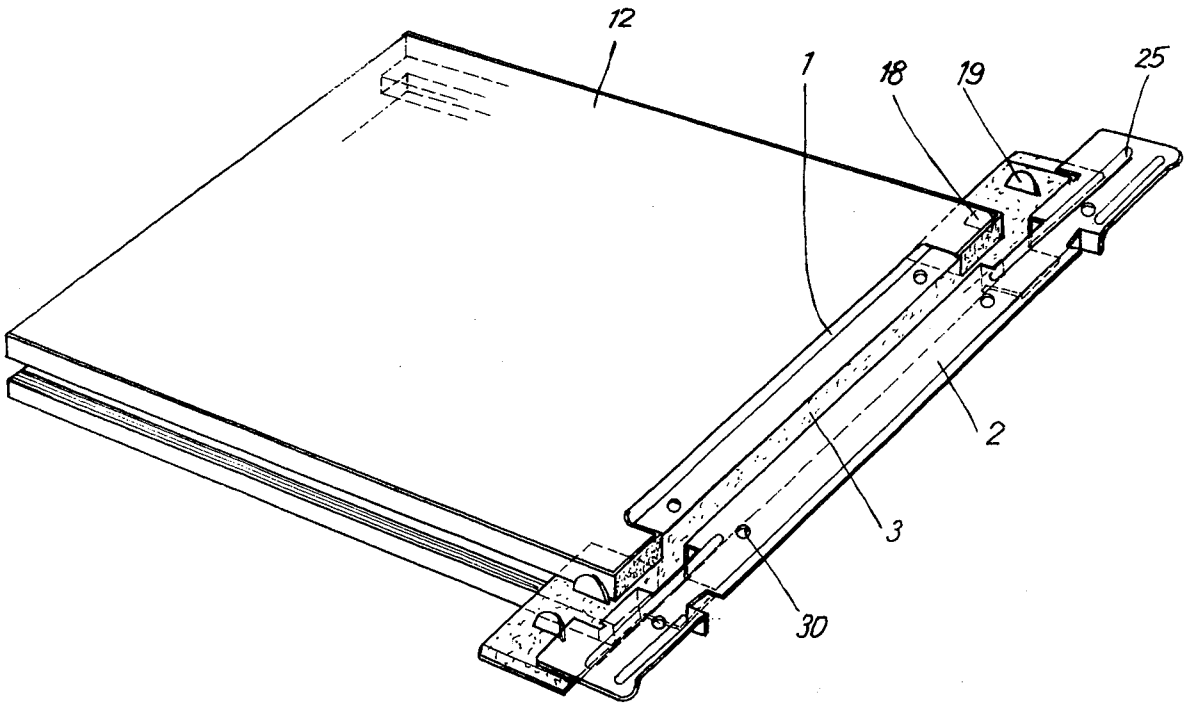
FIG. 8 shows a perspective presentation of the arrangement according to FIG. 5 as seen from the back.
Figure 9A:
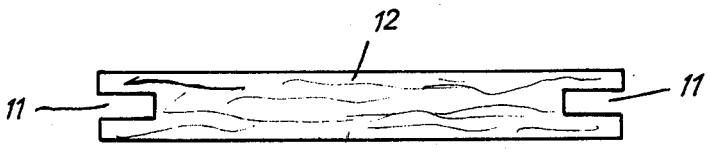
Figure 9B:
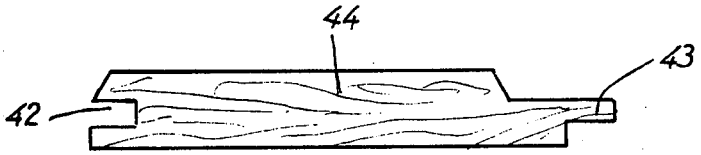
Figure 14:
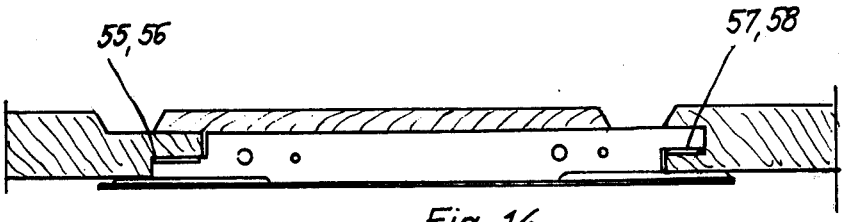
Figure 15:
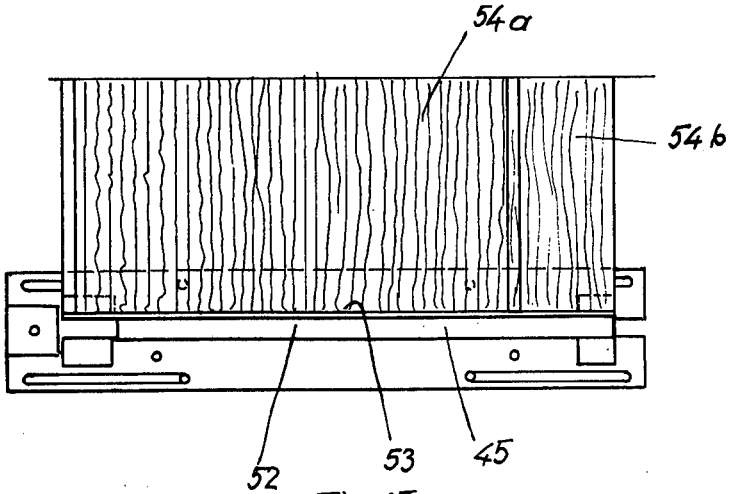

FIGS. 9*a* and *b* are embodiments of the different designs of the panels in cross-section, one having a groove along both sides (FIG. 9*a*), and the other having a groove-and-tongue profile (FIG. 9*b*);

FIG. 10 shows an elevational front view of a modified embodiment of a connecting element according to the invention;

FIG. 11 shows a schematic presentation of the arrangement according to FIG. 10 in a plan view;

FIG. 12 shows a schematic presentation of the arrangement according to FIGS. 10 and 11 in side elevation;

FIG. 13 shows the arrangement according to FIGS. 10 to 12, in perspective, as seen from above at a certain viewing angle;

FIG. 14 shows the connecting element according to FIGS. 10 to 13 connected with a corresponding panel in a front elevation, part of it being in section; and FIG. 15 shows the arrangement according to FIG. 14 in a plan view.

DETAILED DESCRIPTION OF THE PREFERRED EMBODIMENTS

The connecting element shown in FIGS. 1 to 4 serves for the establishment of a connection between panels or cladding boards which are provided, in the way of so-called groove-to-groove profiles, with longitudinal grooves extending along both of their longitudinal edges (panels grooved on either edge). These panels or boards are to be joined together with adjacent panels or boards (seen in the longitudinal direction) by the aid of a separate longitudinal strip constituting as it were the connecting tongue of a tongue-and-groove system, the strip engaging with the grooves in both boards or panels which have to be joined together. The connecting element consists of a sectioned profiled member which comprises two bearing or locating strips 1 and 2, i.e., a "first" locating strip 2 and a "second" strip 1, which serve as supports for the rear surfaces of each of two front edges of boards or panels connected end to end. The locating strips are separated from one another by a gap-forming flange which has a rectangular cross-section and which defines the width of the gap between the adjacent boards when connected, the width of the flange corresponding to the gap between the boards. The longitudinal walls 4 and 5 of the flange serve as locating supports for the front edges of the boards, while the bottom wall 6 constitutes the bottom of the joint-gap. Instead of providing the connecting element with a gap-forming flange 3, a locating wall may be used which projects approximately at right angles from the plane of the supporting strips, or rather, projects upwards, and serves as a stopping and locating element for the front edges of the panels which are joined together.

Figure 1:
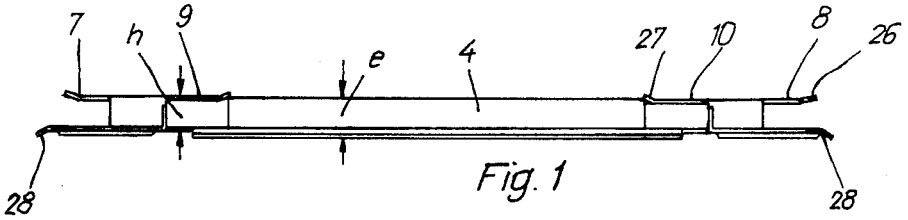
Figure 3:
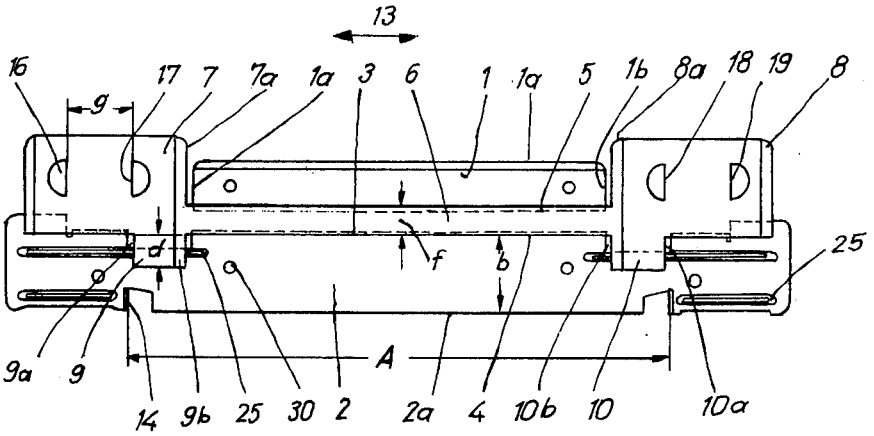
FIG. 3 shows the arrangement according to FIGS. 1 and 2 in a plan.
Figure 2:
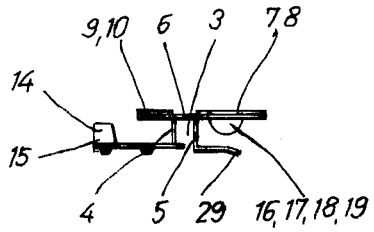
FIG. 2 shows the arrangement according to FIG. 1 in side elevation.
Figure 4:
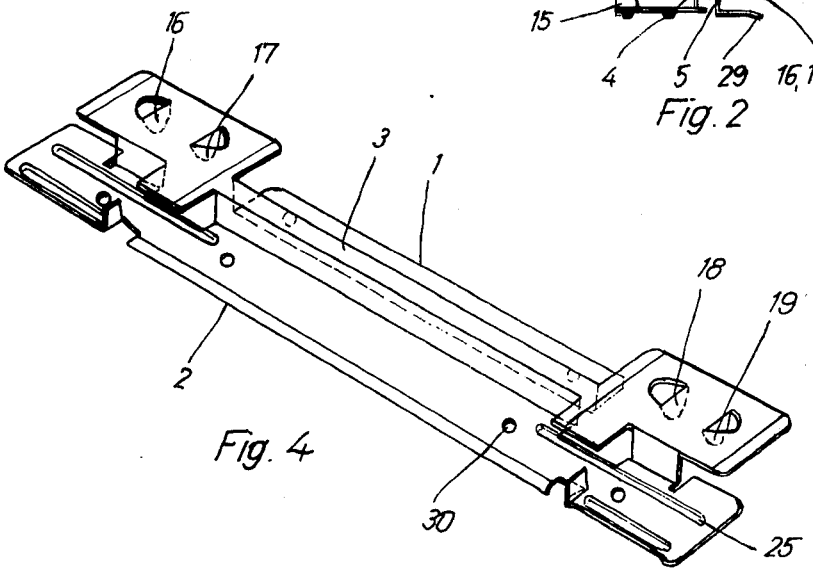
FIG. 4 shows the arrangement according to FIG. 3 in perspective.
Figure 5:
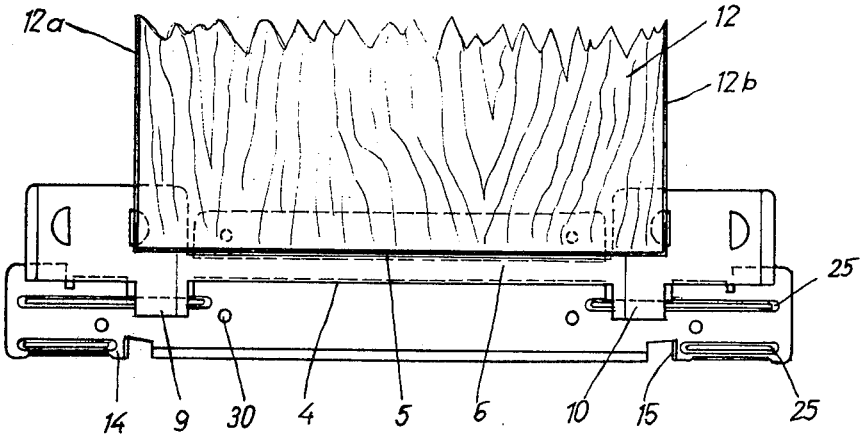
FIG. 5 shows the connecting element according to FIGS. 1 to 4 in a plan view and in its effective position when connected with a panel.
Figure 6:
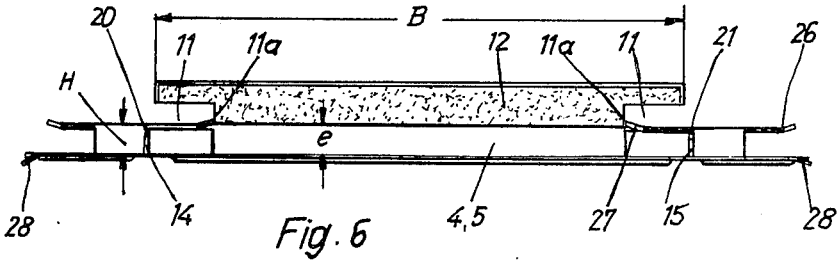
FIG. 6 shows the arrangement according to FIG. 5 in side elevation, part of it in section.

To either end of the locating strips 1, 2, is coordinated a clamping plate 7, 8, 9, 10 to provide a clamped connection between the sectioned element and one of the panels which have to be joined together, the spacing "h" between the clamping plates and the corresponding locating strip approximately corresponding to the space "H" between the locating plate and the longitudinal groove 11 along the boards or panel 12. In addition to this, each locating strip is associated with at least two lateral stops 15, 14 or 16, 17, 18, 19 which fix the corresponding panel in its direction across the longitudinal panel axis (see arrow 13 in FIG. 3), the spacing between these stopping members, such as distance A between the stops 14 and 15 or between the stops 17 and 18, corresponding to the distance B between the two adjacent longitudinal edges 20, 21 of the corresponding boards. These clamping plates 9, 10 or 7, 8 are coordinated in sets of two to the locating strips 1, 2, the pairs of clamping strips and locating strips extending in opposite directions along the two longitudinal sides of the gap-forming flange. The "first" lateral stops 14, 15 which project upwards from the first locating strip 2 extend in the direction towards the longitudinal groove 11, their spacing "A" corresponding to the spacing between the longitudinal side edges 20, 21, of the panel as mentioned above. These first lateral stops 14, 15 consist of sections bent to extend upward towards the panel surface which is located opposite and these bent sections may have, for example, a rectangular outline. To these "first" or outermost lateral stops are coordinated two clamping plates 9, 10 which, for easier interpretation of the design, are defined as the "first" clamping plates. These plates project from the gap-forming flange 3, or more precisely from its side which is adjacent to the locating strip 2, towards the outer edge 2*a* of the corresponding locating strip. They extend parallel to the latter, their outer edges 9*a* and 10*a* respectively being contained approximately in the plane of the lateral stops 14, 15 or 17, 18, respectively, while their inner edges 9*b* and 10*b*, respectively, are preferably contained in the plane of the root 11*a* of the longitudinal grooves along the panel (see FIG. 6). These "first" clamping plates 9, 10 constitute, together with the gap-forming flange 3, an integral member. The width "D" of the first locating strip 2 exceeds the width "d" of the corresponding clamping plates 9, 10 which agrees approximately with the height "e" of the flange 3. The width of this first locating strip 2 may thereby be 1.5 to 2.0 times greater than that of the locating strip 1, the difference between its width and that of this second locating strip corresponding approximately to the width "f" of the gap-forming flange 3. This particular design has certain advantages in manufacture and assembly.

To increase the resistance to bending, the first locating strip 2 is, for example, provided with longitudinal stiffening ribs 25 in the form of two parallel flanges in its end section. The so-stiffened gap-forming flange 3 considerably increases the stiffness of the entire sectioned member.

The two clamping plates 7, 8 are associated with the "second" locating strip 1. Projecting from the side of the gap-forming flange which is remote from the locating strip in a direction towards the outer edge of the corresponding locating strip (the outer edge 1*a* of the corresponding locating strip) they extend parallel to the latter and are located approximately in the plane of the clamping plates 9, 10 for the first locating strip, their width exceeding that of the pertinent second locating strip 1, for example, by a value which corresponds to the height "e" of the gap-forming flange 3. The front edges 1*a*, 1*b* of the second locating strip are thereby located approximately in the plane of the outer front edges 7*a*, 8*a* of the associated clamping plates 7, 8. The arrangement is, moreover, such that the length of the first locating strip 2 is at least equal to, and preferably slightly exceeds, the sum of the lengths of the second locating strip 1 plus that of the two clamping plates 7, 8. Again, the above dimensions have been chosen for reasons of manufacturing techniques. The design permits cutting the profile of the connecting piece or sectioned element in one pass from a rectangular blank, so that it is fully integral. The clamping plates 7 and 8, which are connected to the second locating strip 1 and the gap-forming strip 3, constitute thereby one single piece. Again, they are formed by bending the material so that they extend from the basic wall, the plates which extend in opposite directions being bent in such a manner that each of the end sections are located in the same plane as the gap-forming flange.

Each of the clamping plates 7, 8 which are associated with the "second" locating strip 1 are provided with two lateral stops 17, 18 and 16, 19, respectively, which are separated from one another by a spacing "g". The inner stop 17 or 18, respectively, is thereby associated with the outer longitudinal edge of the corresponding panel and rests, in the assembled state, against its outer surface, while the outer stop 16 or 19 is coordinated to the outer longitudinal edge of the adjacent panel which is joined to it in the direction across the longitudinal axis of the connecting element. In this manner it is ensured that the individual panels or boards are accurately positioned when they are mounted consecutively in the longitudinal direction of the cladded wall, with a joint-gap maintained between them whose width is determined by the width of the gap-forming flange 3 so that the panels, related to their longitudinal median axis, constitute a coaxial system. On the other hand, the positioning of the boards in the direction across the longitudinal axis of the connecting element is controlled by the aid of the stops 16, 17, and 18, 19, respectively, which ensure that the distance between the longitudinal edges of each two adjacent boards is maintained constant, thus complementing the effect of the tongue-and-groove system. The spacing "g" between the two lateral stops 16, 17 and 18, 19, respectively, which are associated with the second locating strip corresponds thereby to the width of the longitudinal joint gap between the boards or panels joined together across the longitudinal direction, and thus contributes to the determination of the gap dimensions.

The edge sections which are associated with each other, and especially the longitudinal and face-edges of the two locating strips and the corresponding clamping plates of the first locating strip, are bent outwards slightly so that they diverge from one another, thus facilitating the fitting of boards and panels between the strip and plates. This is clearly demonstrated in FIGS. 1 and 6 where the face-sections are shown to diverge (26, 27, 28), and in FIG. 2 at 29. The two locating strips are, moreover, provided with several holes, each comprising for example two, three or four holes 30 into which nails, screws, or the like may be inserted.

When assembling the components, the connecting elements or sectioned members are attached to the rear surface of one of the panels 12, attaching for example the locating strip 2 in such a manner that the two locating strips 1 and 2 extend upwards, after which the boards or panel is positioned across the longitudinal direction, using the two lateral stops 14, 15 which have to rest against the longitudinal edges 12*a* and 12*b*. Next, the adjacent board 121 is fitted to the locating strip 1, in the longitudinal direction, its position in relation to the longitudinal median axis being controlled by the aid of the lateral stops 17, 18, whereby the gap-forming flange determines the width of the gap between the two assembled boards. The longitudinal median axis of the profiled connecting element extends thereby approximately at right angles to the longitudinal median axis of the assembled panels. Each of the panels is held in position by means of their corresponding locating strip and the pair of clamping plates associated therewith, the latter engaging with the corresponding longitudinal groove in the panels, fixing thereby the lower section of the panel between themselves and the locating strip. The cladding work may now be continued by repeating the above in the longitudinal direction. The longitudinal mounting strips 35, 36, being independent of the panels and, as explained above, serving as tongues, are inserted into the longitudinal grooves of the boards or panels in such a manner that they are located between the upper side of the clamping plate which engages with the panel, and the groove wall opposite. In other words, the clamping plates always rest against the inner surface of the corresponding groove-jaw, clamping the jaw at the back of the panel between themselves and the corresponding locating strip. The cladding board adjacent to the assembly in the direction across the longitudinal axis may be fitted analoguously, whereby the same is positioned between the section 40 of the "first" locating strip 2, which lies beyond the lateral stops 14, 15, and the section 41 of the clamping plates 7 and 8 beyond the lateral stops 16, 19. The accurate fixing position of these added panels and consequently the width of the gaps in the direction across the longitudinal direction, are determined by the lateral stops 16 and 19. The illustration shows that each profiled connecting element 54*b* is holding four panels in position, namely the pannels 12, 121, 122 and 123, the length of the sectioned connecting element being greater than the sum of the panel width plus the depth of the longitudinal grooves 11 of the two panels which extend at either side of the connecting element. This supporting connection between the profiled connecting element and the corresponding panels occurs exclusively in the region of the longitudinal grooves and there is no need for a treatment of the panel end-faces.

FIGS. 10 to 15 illustrate a second variant of the connecting element according to the invention which is designed for connecting cladding boards or panels which, unlike the panels 12 with two longitudinal side grooves 11 (FIG. 9*a*), are provided on one side with a longitudinal groove 42 and, on their other longitudinal edge on the opposite side, with a projection 43 which engages with the groove of the adjacent board (panel 44), thus constituting a tongue-and-groove system (solid wood cladding). Again, two locating strips 50, 51 are used upon which the rear surfaces of two adjacent end-faces of the assembled boards or panels are positioned and which, again, are separated from each other by a gap-forming flange 52 which determines the width of the joint-gap between the adjacent boards and has a rectangular cross-section, the flange width corresponding to the gap between the boards as shown, for example, in FIG. 15, and the longitudinal flange walls serving as locating elements for the end edges 53 of the panels or boards 54*a*, 54*b*, the ground wall 45 constituting the bottom of the joint-gap. As above, there are clamping plates 55, 56, 57, 58 connected to either end of the locating strips, their object being to provide a clamped connection between the profiled connecting element and one of the boards which are joined together, the distance "c" between the clamping plates and the corresponding locating strip corresponding approximately to the distance between the locating strip and the longitudinal groove in the panel. Again, at least two lateral stops are provided which fix the corresponding board in its direction across the longitudinal axis. In this case, they are in the form of edges 57*a*, 58*a*, and 55*a*, 56*a*, respectively, and the edges 57*b*, 58*b*, and 55*b*, 56*b*, respectively. The spacing between these stopping members corresponds to the spacing between the groove-ground walls in the longitudinal grooves which take part in the connection of a boards with the two adjacent boards on either of its longitudinal sides. Here again, the arrangement is such that the clamping plates are coordinated in pairs to the locating strips, the pairs of clamping plates and locating strips extending at the two longitudinal sides of the gap-forming flange in directly opposite directions. Hereby is associated with each axial end of the gap-forming flange a pair of clamping plates which project from the flange in two directions opposite to each other, the clamping plates forming an integral part of the gap-forming flange so that the four clamping plates which are associated with one given gap-forming flange are located in one and the same plane. The illustrations also show that in this case the height of the gap-forming flange exceeds that of the clamping plates.

The two locating strips which are co-ordinated to the same gap-forming flange are of equal length and have the same width, the sum of the gap-forming flange plus clamping plate corresponding to the total width of the corresponding board including its integral tongue. The length of the locating strips exceeds that of the gap-forming flange, whereby the two axial ends of the locating strips preferably project by approximately the same amount. In this case the clamping plates are formed by bending the side walls of the flange. In the case of clamping plates 57, 58, the connection between the side wall of the gap-forming flange is broken, and this side wall is bent outwards approximately halfway up its height. In the case of the clamping plates 55, 56, the side wall of the gap-forming flange is disconnected from the ground wall 52, and the side wall is again bent outwards approximately halfway up its height. The upper edges of the clamping plates 55, 56 are thereby free, the plates being supported at their bottom end by the gap-forming flange, while the two clamping plates 57, 58 at the other axial end of the flange are free at the bottom, their upper side being supported by the gap-forming flange. When assembling the panels, the profiled connecting element is placed against the front edge of one of the panels in such a manner that the locating strips engage with the boards from their under- or rear-side, whereby the clamping plates 55, 56 engage with the groove so that the material is clamped between themselves and the locating strip, while the clamping plates 57, 58 rest against the underside of the projecting tongue of the opposite longitudinal edge of the cladding board, so that the subsequent board lies between this clamping plate and the corresponding locating strip, its lower section (the groove wall on the rear side) being in active contact, while the upper or frontal groove jaw engages with the tongue.

Although my invention has been illustrated and described with reference to the preferred embodiments thereof, I wish to have it understood that it is in no way limited to the details of such embodiments, but is capable of numerous modifications within the scope of the appended claims.

Having thus fully disclosed my invention, what I claim is:

1. A connecting element useful in the assembly of abutting end faces of wall- or ceiling-cladding panels when assembled by the so-called dry construction method wherein the assembly is by abutting the end faces of cladding panels which have the same width and which are assembled by connecting the region of their longitudinal edges through a tongue-and-groove system, wherein the connecting element consists of a sectioned member whose longitudinal median plane, when in use, extends across that of the assembled panels, the sectioned member including two locating strips positioned, at least approximately, in the same plane and which function as supports for the undersides of end face sections of two adjacent panels which are to be assembled end to end, and which strips include stiffening flanges and holes for fixing screws or the like; said sectioned member also including a gap-forming flange having a locating wall between said locating strips for locating the end faces of assembled panels, said gap-forming flange separating said locating strips and having an essentially rectangular cross-section which determines the width of the joint gap, said locating wall projecting approximately at right angles from the plane of the locating strips; wherein at least one longitudinal end of each locating strip is connected with a clamping plate capable of establishing a clamped connection between the sectioned member and one of the panels when assembled, the spacing between said clamping plate and the corresponding locating strip being approximately equal to the distance between the locating strip and a longitudinal groove in the panel, and wherein at least two lateral stops are provided for each locating strip in the direction across the longitudinal axis of the connecting element, the spacing between the stops corresponding either to the distance between two longitudinal side edges of a corresponding panel when assembled therebetween or to the distance between the ground-surfaces of the longitudinal grooves of a panel to be assembled which take part in the connection between a given panel and adjacent panels at either of its longitudinal sides.

2. A connecting element according to claim 1, wherein the clamping plates are coordinated in pairs to the longitudinal ends of said locating strips and wherein these pairs of clamping plates and locating strips extend from either side of the gap-forming flange in opposite, longitudinal directions, said clamping plates functioning to rest against the inner walls of the rear groove-jaw in a panel, anchoring it between each other and the corresponding locating strip.

3. A connecting element according to claim 2, wherein each sectioned member is longitudinally longer than the sum of a panel width plus the depth of the longitudinal grooves of the panels adjacent either longitudinal end, and is capable of supporting four panels such that two consecutive panels which butt against each other in one direction are supported in the region of the gap-forming flange, and one panel of each of the longitudinal directions at either longitudinal end being supported in the region of either end-section, the locating connection between the sectioned connecting elements and the corresponding panels being limited to the regions of the longitudinal grooves.

4. A connecting element according to claim 3, which serves for the connection of panels having a longitudinal groove along either of their longitudinal edges, the consecutive panels being joined together in the longitudinal direction by means of independent longitudinal strips which engage with each of the grooves in the assembled panels, and wherein the sectioned element includes first lateral stops in the form of lugs bent out of the first of the two locating strips such that they extend from the first locating strip in the same direction as said gap-forming flange and having a rectangular outline, the spacing between said lateral stops corresponding to the space between the longitudinal side edges of the panel, and two clamping plates extending from the gap-forming flange towards the outer edge and in parallel with the corresponding locating strip and formed as an integral part of the gap-forming flange, said plates being associated with said lateral stops such that their outer edges are located approximately in the plane of the lateral stops and their inner edges preferably being located approximately in the panel of the groove ground surfaces of the longitudinal grooves of the assembled panels.

5. A connecting element according to claim 4, wherein the width of the first locating strip exceeds the width of the corresponding clamping plates, the latter corresponding approxmiately to the height of the gap-forming flange whereby the width of the first locating strip which supports the first lateral stops preferably exceeds the width of the second locating strip by about a value corresponding to the width of the gap-forming flange.

6. A connecting element according to claim 5, wherein second clamping plates are associated with the two longitudinal ends of the second locating strip, extending from the side of the gap-forming flange which is remote from the locating strip towards the outer edge of the corresponding locating strip in a parallel arrangement and constituting an integral part of the gap-forming flange, said clamping plates being located approximately in the plane of the first clamping plates which are connected to the first locating strip and whose width exceeds that of the second locating strip by a value corresponding approximately to the height of the gap-forming flange.

7. A connecting element according to claim 6, wherein the end-edges of the second locating strip are contained approximately in the same plane as the end-edges on the outer sides of the associated clamping plates, the length of the first locating strip being as great as or greater than the sum of the lengths of the second locating strip plus the two associated clamping plates.

8. A connecting element according to claim 7, wherein the clamping plates which are associated with the second locating strip are contained in the same plane as the clamping plates associated with the first locating strip, the clamping plates being bent out of the side wall of the gap-forming flange so that they extend in opposed directions, each preferably supporting two lateral stops, respectively, which are separated from one another by a longitudinal spacing which corresponds to the width of the longitudinal gap between two panels connected with each other across the longitudinal direction, the inner stops being coordinated to the outer longitudinal side edge of the corresponding panel against which it rests from the outside when the units are assembled, while the other outer stops are associated with the outer longitudinal side edge of the panel adjacent to it in the direction across the longitudinal direction, the stops resting, in the assembled state, against the outer panel surface.

9. A connecting element according to claim 3 which serves for the assembly of panels comprising on one of their longitudinal side edges a longitudinal groove and in the region of the groove on the opposite edge a tongue-like integral projection which is outwardly directed and fits into the longitudinal groove of the immediately adjacent panel with which it may engage in a mating connection, wherein a pair of clamping plates are associated with either of the axial ends of the gap-forming flange, and project in opposed directions from the flange of which they form an integral part, and are located in one common plane, the clamping plates engaging with the gaps of the two panels which are immediately adjacent, each being contained between the inner surface of the jaw in the rear end of the corresponding longitudinal groove and the adjacent surface of the tongue which engages with the groove, the two corresponding locating strips having the same lengths and widths.

10. A connecting element according to claim 9, wherein the height of the gap-forming flange exceeds that of the clamping plates and wherein the sum of the lengths of the gap-forming flange and clamping plates corresponds to the width of an associated panel including its integral tongue, the length of the locating strips being greater than that of the gap-forming flange.

11. A connecting element according to claim 10, wherein the clamping plates formed out of side walls of the gap-forming flange at one axial end of the gap-forming flange are open towards the top and are supported by the flange, while the clamping plates at the other axial end are open towards the bottom, their upper side being supported by the gap-forming flange.

* * * * *